US006333712B1

(12) United States Patent
Haugse et al.

(10) Patent No.: US 6,333,712 B1
(45) Date of Patent: Dec. 25, 2001

(54) STRUCTURAL DEFORMATION COMPENSATION SYSTEM FOR LARGE PHASED-ARRAY ANTENNAS

(75) Inventors: Eric David Haugse, Normandy Park, WA (US); Robert Irving Ridgway, San Jose; Charles Howard Hightower, San Clemente, both of CA (US); Ryon Christopher Warren, Kent, WA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 09/434,418

(22) Filed: Nov. 4, 1999

(51) Int. Cl.[7] ..... H01Q 3/22
(52) U.S. Cl. ..... 342/375; 342/368; 342/81
(58) Field of Search ..... 342/81, 154, 157, 342/368, 369, 375

(56) References Cited

U.S. PATENT DOCUMENTS

| | | | | |
|---|---|---|---|---|
| 3,706,989 | | 12/1972 | Taylor, Jr. . | |
| 4,550,589 | * | 11/1985 | Wright | 73/11 |
| 4,586,051 | | 4/1986 | Saitto et al. . | |
| 4,811,022 | | 3/1989 | Cafarelli et al. . | |
| 4,819,000 | | 4/1989 | Meyer . | |
| 5,200,758 | | 4/1993 | Gillard . | |
| 5,450,448 | | 9/1995 | Sheynblat . | |
| 5,526,291 | | 6/1996 | Lennen . | |
| 5,561,667 | | 10/1996 | Gerlach . | |
| 5,613,193 | | 3/1997 | Ishikawa et al. . | |
| 5,757,677 | | 5/1998 | Lennen . | |
| 5,856,804 | | 1/1999 | Turcotte et al. . | |
| 6,041,582 | * | 3/2000 | Tiede et al. | 56/10.2 A |

* cited by examiner

*Primary Examiner*—Dao Phan
(74) *Attorney, Agent, or Firm*—Harness Dickey & Pierce P.L.C.

(57) ABSTRACT

A deformation compensation system for use with a large phased-array antenna system to electronically compensate for surface deformations occurring on the phased-array antenna which would otherwise compromise antenna performance. In one embodiment, a plurality of strain gauges are disposed on or integrally formed in structure forming the phased-array antenna. The strain gauges are placed at those locations on the antenna structure, where, through prior structural modeling and testing, it has been determined that high strains associated with the expected deformation of the phased-array antenna are expected to occur to a significant degree. The strain gauges output signals to a data acquisition system which uses a strain-to-displacement algorithm to produce displacements corresponding to the estimated, deformed shape of the phased-array antenna. These displacements are input to a beam steering controller which is used to generate phase shift or time delay commands used for electronically compensating, in real time, for the overall estimated, deformed shape of the phased-array antenna. The invention eliminates the need for heavy and large structural supports or trusses which have traditionally been required to maintain surface planarity of a large, phased-array antenna, and further enables the use of even larger phased-array antennas in space-based applications. The invention enables surface deformation to be compensated for in a non-intrusive manner which does not significantly increase the overall complexity of the phased-array antenna system.

17 Claims, 7 Drawing Sheets

Optimal Strain Sensor Locations, Short(x), Long(y)

Optimal Strain Sensor Locations, Short(x), Long(y)

STRUCTURAL DEFORMATION COMPENSATION SYSTEM FOR LARGE PHASED-ARRAY ANTENNAS

TECHNICAL FIELD

This invention relates to large phased-array antennas, and more particularly to a structural deformation compensation system for compensating for surface deformations in a large, space-based, phased-array antenna.

BACKGROUND OF THE INVENTION

Current spacecraft often employ large, phased-array antennas to perform reconnaissance missions, collect radar images, track ground-based and air-based targets and provide high bandwidth communications. These large, phased-array antennas are made up of a large plurality of independent antenna elements. The surfaces forming the phased-array antenna must be maintained very flat or the distortion in the antenna surface must be known to within a very small fraction of the wavelength corresponding to the operational frequency of the antenna (e.g., one-thirtieth of the wavelength for space-based radar at 10 GHz=1 mm flatness tolerance) in order for the antenna to perform correctly. In particular, for space-based radar (SBR) applications, a very high degree of surface planarity must be maintained to enable the effective use of ground clutter suppression algorithms. A high degree of surface planarity is also critical for space-based optics applications and ground moving target tracking applications.

Present day large, phased-array antennas achieve this required flatness by using high stiffness structural designs (i.e., trusses) that add significant weight and volume to the antenna when it is stowed in a launch vehicle. As will be appreciated, as the antenna area increases, the stowed volume of the array limits the antenna size due to the restrictions imposed by the launch vehicle fairing within which the stowed antenna must fit.

Other systems for measuring the flatness of planar structures have relied on metrology devices that measure the distance from a common source to pre-determined points on the structure, typically through laser reflection from a surface mounted target. For large, deployable, space-based phased-array antenna systems, there is a need for a measurement system that does not interfere with the operation of the antenna, and which provides feedback, in real time, and which further does not add significantly to the complexity of the antenna system or to the spacecraft with which it is associated.

Accordingly, it is a principal object of the present invention to provide a system for compensating for deformation occurring in a large, phased-array antenna which eliminates the need for large and heavy structural members, such as trusses, to maintain the planarity of the antenna when the antenna is subjected to external factors which would otherwise cause a deformation of its surface.

It is another object of the present invention to provide an apparatus and method for electronically compensating, in real time, for the deformation experienced by a large, phased-array antenna through non-intrusive means which permit the deformation to be monitored and suitable corrections generated to provide needed phase shifting or time delay of the signals transmitted by or received by the phased-array antenna.

It is still another object of the present invention to provide a system for detecting and compensating for the deformation occurring in a large, phased-array antenna, in real time, without significantly complicating the construction of the antenna and without impeding the ability of the antenna to be deployed in space-based applications.

SUMMARY OF THE INVENTION

The above and other objects are provided by a structural deformation compensation system and method for use with a large, phased-array antenna. The system and method of the present invention are particularly well adapted for use with large, spaced-based, phased-array antennas, but could just as readily be implemented with ground-based or aircraft based phased-array antennas.

The present invention employs a number of deformation sensing devices which are either placed on or formed within structure supporting the antenna elements of the phased-array antenna at predetermined locations on the antenna where significant stresses or strains are expected to occur. In one preferred embodiment the deformation sensing devices are comprised of strain gauges. At least one such strain gauge is disposed on, or formed within, the composite structure supporting the phased-array antenna at each of those locations where strains are expected to occur as a result of the external forces experienced by the antenna which can cause deformation of the antenna. In some applications, a pair of strain gauges are preferably located at each such location. If a pair of strain gauges is used, then one of each pair may be orientated in the X direction and the other may be orientated in the Y direction. Each strain gauge provides output signals indicative of the stresses experienced by the phased-array antenna at that approximate location where it is located.

The output signal from each strain gauge is then input to a data acquisition system which makes use of a transformation algorithm for transforming the detected surface strains into signals representing the displacements of the antenna at various locations thereof. Electronic signals corresponding to these displacements are then output to a beam steering controller which generates phase or time delay commands needed to provide the necessary degree of phase shifting or time delay of the signals transmitted or received by the antenna elements making up the phased-array antenna to correct for the estimated overall deformation of the phased-array antenna. In this manner, the antenna can be electronically "steered" to compensate, in real time, for the deformations occurring over the entire area of the phased-array antenna as a result of various factors, such as changes in temperature, experienced by the antenna. Advantageously, the compensation of surface deformation is accomplished "non-intrusively" and without interfering with normal antenna operation.

In one preferred embodiment, the deformation sensing devices are comprised of fiber-optic strain gauges which output signals to a fiber-optic strain demodulator. The fiber-optic strain demodulator, in turn, provides corresponding signals to the data acquisition system. In this embodiment true-time-delay (TTD) units are used for receiving the output signals from the beam steering controller to electronically compensate for the surface deformations of the antenna. The beam steering controller may also receive attitude information concerning the antenna if the antenna is a space-based antenna system. A beam pointing command generated is also used to supply beam pointing commands to the beam steering controller.

The method of the present invention makes use of suitable surface modeling equations developed during laboratory testing and on-orbit measurements made for space-based, large, phased-array antennas in order to collect a sufficient number of modes to represent displacements likely to occur as a result of predicted load conditions which the antenna will likely experience. From this testing a suitable "strain-to-displacement" algorithm is developed. The information obtained from ground-based testing and on-orbit measurements is also used to optimize the number and location of the strain gauges used on the antenna. This information is then used to place deformation sensing devices at those locations on the antenna where significant degrees of strain are likely (i.e., predicted) to occur. The strain-to-displacement algorithm is used by the data acquisition system to generate displacement signals corresponding to the strains occurring at those approximate areas of the antenna where the deformation sensing devices are located.

The apparatus and method of the present invention thus provides a means for compensating for surface deformations occurring over the entire area of a large, phased-array antenna system, in real time, and further in a manner which allows smaller, lighter and less costly antenna support structures to be used.

BRIEF DESCRIPTION OF THE DRAWINGS

The various advantages of the present invention will become apparent to one skilled in the art by reading the following specification and subjoined claims and by referencing the following drawings in which:

DETAILED DESCRIPTION OF THE PREFERRED EMBODIMENTS

Figure 1:
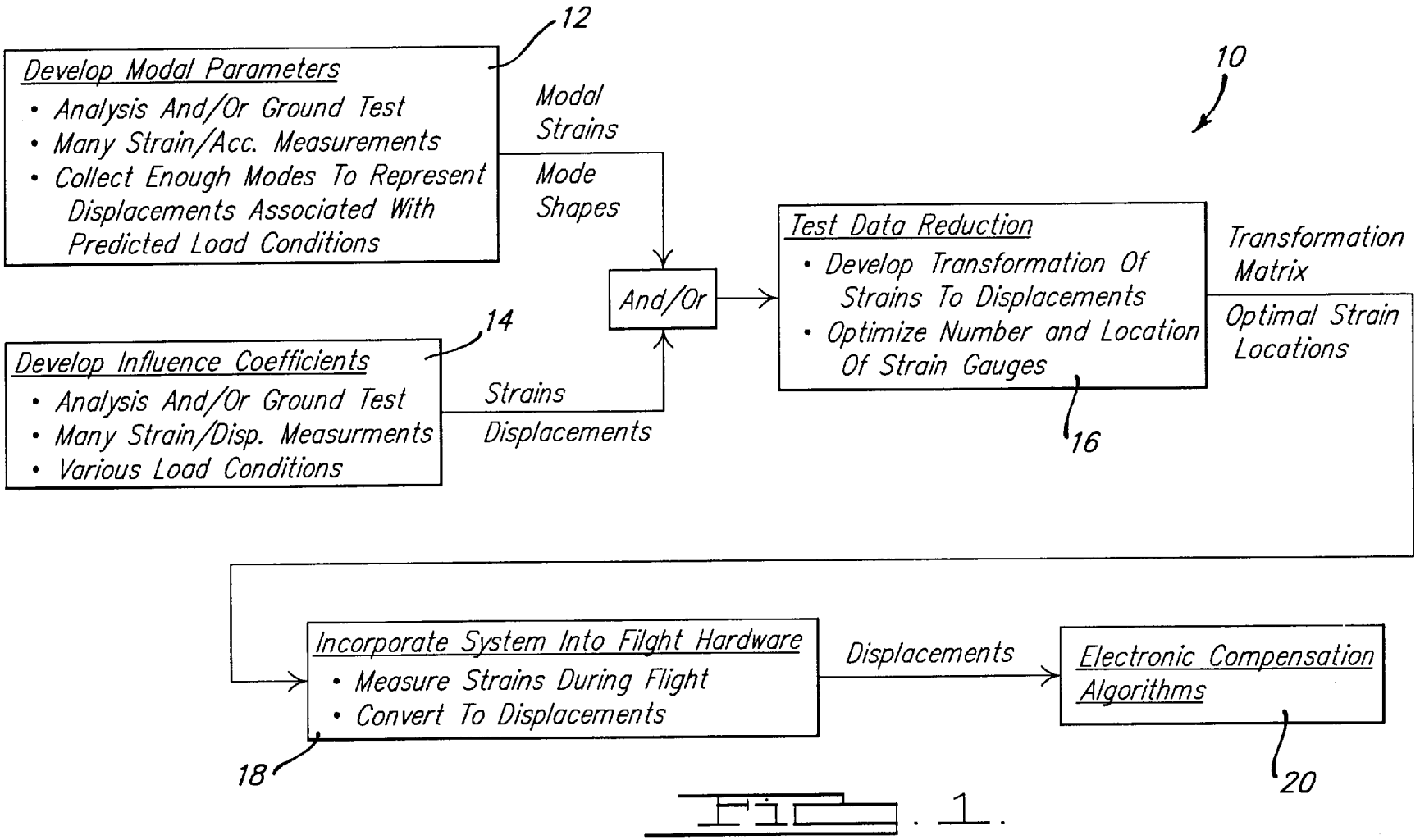
FIG. 1 is a simplified flow chart of the steps performed to produce the strain-to-displacement transformation matrix and the optimal locations for the strain gauges used by the present invention, in addition to the steps of using the predicted displacements to compensate for the detected deformation of a large, phased-array antenna.

Referring to FIG. 1, there is shown a flowchart 10 illustrating the general steps performed in developing a strain-to-displacement transformation matrix for predicting the displacements normal to a surface of a large, phased-array antenna. Initially, step 12 involves performing ground-based tests of suitable structures and collecting a sufficient number of modes to represent displacements associated with predicted load conditions on the structure. Step 14 indicates that strain gauge and accelerometer measurements are also preferably collected from on-orbit antennas. More specifically, these steps involve using modal testing to collect accelerometer frequency response functions (AFRF) and strain frequency response functions (SFRF). Displacement and strain modes (eigenvectors) are then generated from this data. The strain modes are used to develop a least squares transformation from strain measurements to modal coordinates. As indicated at step 16, the displacement modes are then used to transform modal coordinates to displacements.

Analytically, using finite element techniques, strain modes can be developed by using displacement eigenvectors to generate strains from typical strain recovery transformations (SRT). Experimentally, strain gauges and accelerometers need to be attached to the antenna structure and then outputs recorded simultaneously during dynamic testing. This information is also used to determine the optimal number and location of deformation sensing devices (i.e., strain gauges) that will be needed on a phased-array antenna of particular dimensions in order to accurately determine the overall surface deformation of the antenna when the antenna is in use.

At step 18, the information determined at step 16 is used to predict the actual surface deformation at various points on a large, phased-array antenna during use of the antenna. The information obtained at step 18 is then used by a deformation compensation system, as indicated at step 20, to compensate for the detected surface deformations of the antenna. It will be appreciated, then, that steps 12–16 comprise those steps which will be needed to not only determine the needed strain-to-displacement transformation matrix for the particular shape of phased-array antenna that will be employed, but also to determine the optimal locations of the deformation sensing devices on the antenna so as to be able to accurately predict the deformation that will be experienced by the antenna during use.

Figure 2:
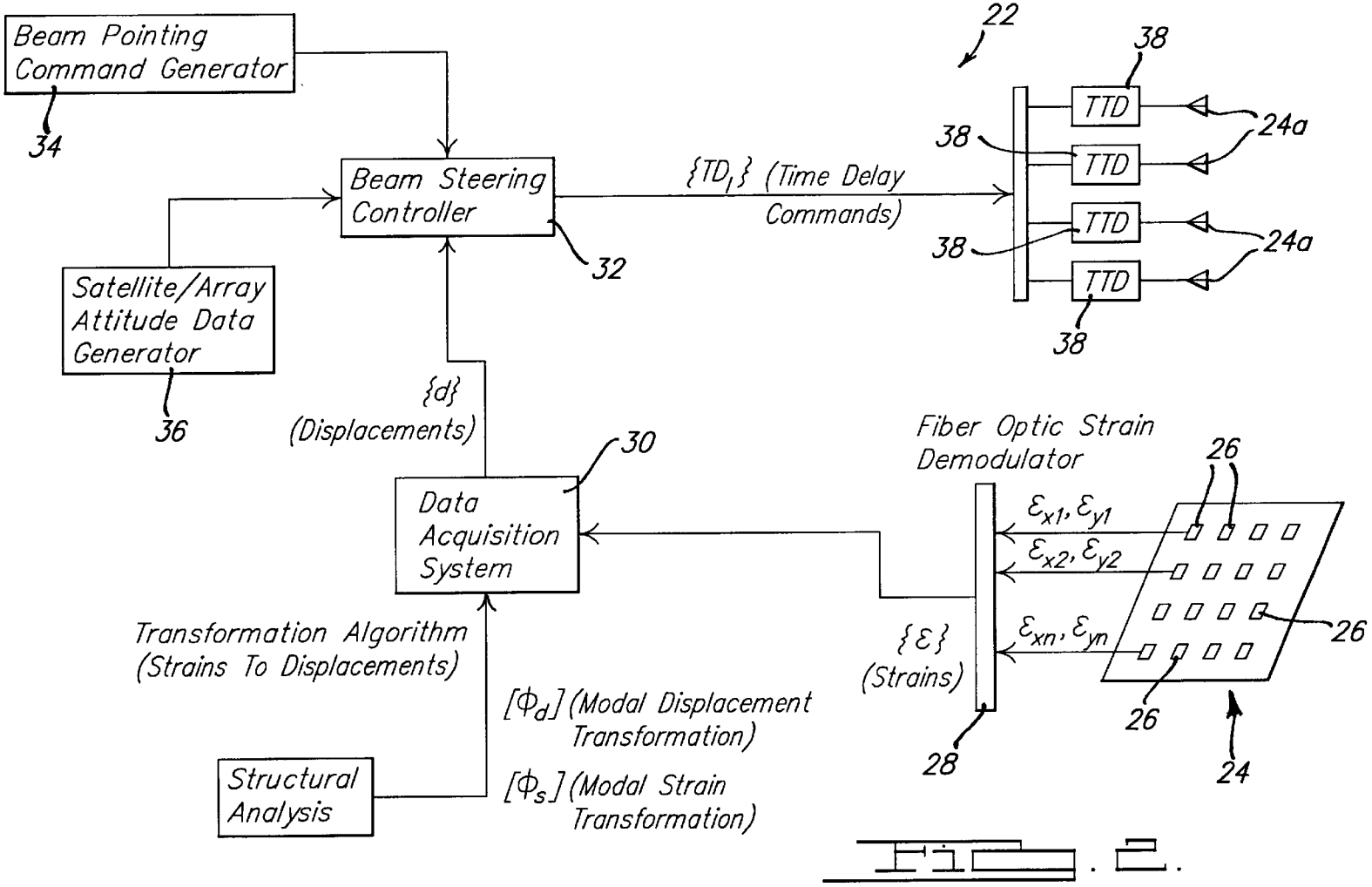
FIG. 2 is a simplified block diagram of the system of the present invention.

Referring now to FIG. 2, there is shown a system 22 in accordance with a preferred embodiment of the present invention for detecting and compensating for surface deformations in a large, phased-array antenna system. The phased-array antenna is represented in simplified form by a planar antenna panel 24 having a plurality of independent antenna elements 24*a* and a plurality of pairs of deformation sensing devices 26, represented in simplified form by squares, disposed about its overall area. It will be appreciated that antenna elements 24*a* have been shown apart from the panel 24 only to simplify the drawing figure, but in practice will be disposed on or within the panel 24, as will be explained more fully in the following paragraphs.

Figure 3:
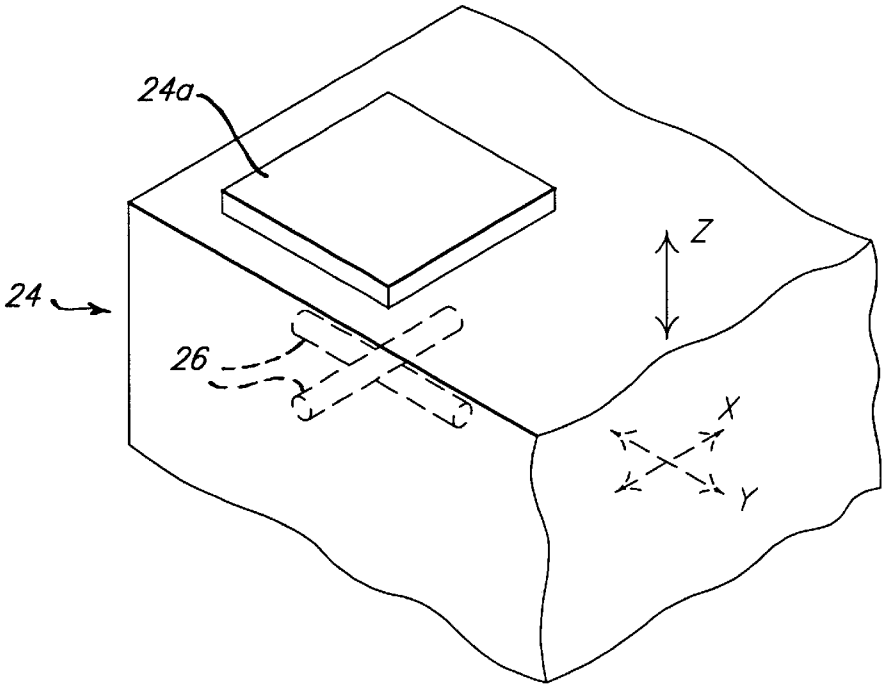
FIG. 3 is a highly simplified perspective view of a portion of a phased-array antenna illustrating one preferred arrangement of a pair of deformation sensing devices embedded therein.

Deformation sensing devices 26, in one preferred embodiment, comprise strain gauges, and more preferably Bragg grating fiber-optic strain gauges. However, any suitable device capable of sensing the strain occurring in its immediate area could be used. The strain gauges 26 detect the strain of that portion of the panel 24 at the approximate area where they are located. As shown in FIG. 3, in one preferred embodiment, one of each pair of the strain gauges 26 is disposed on the panel 24 along an X axis while the second one of the pair is disposed perpendicularly thereto along a Y axis. The X axis strain gauge senses the x-axis component of the strain occurring at its location and the Y-axis strain gauge senses the Y-axis component of the strain occurring at its location, both of which are used to predict the deformation of the surface of the antenna panel in the Z direction normal to the antenna 24 surface. Both strain gauges 26 may be disposed within a composite structure forming the panel 24 while the antenna elements 24*a* are integrated into large suitable supporting structure, such as possibly being clipped onto large, grid stiffened panels. Alternatively, one of the strain gauges 26 may be disposed on the outer surface of the panel 24 while the other is embedded within the panel.

It will be appreciated that in some structures only a singe deformation sensing device may be needed at various determined locations on the panel 24, depending on the expected deformed shape of the panel. Also, various shapes of panels 24 may require pairs of devices 26 to be disposed at predetermined locations with the devices 26 being orientated non-perpendicular to each other.

The pairs of strain gauges 26 are further disposed at those locations (determined at step 16 of FIG. 1) where previous laboratory and/or space-based testing and analysis has determined that stresses are likely to occur as a result of the antenna panel 24 experiencing external forces that cause it to deform in shape. It will be appreciated that those locations may not necessarily be at the same areas where displacement is expected to occur. For example, a long, cantilevered antenna panel may be expected to experience significant stresses at the end thereof where it is secured to supporting structure, but the majority of surface displacement of the antenna will be known to occur for such an antenna at specific other areas located substantially away from those points where the majority of stresses in the panel will occur. It will be appreciated immediately, then, that while the pairs of strain gauges 26 are illustrated on the antenna panel 24 as being evenly spaced apart along the X and Y directions, that in practice the strain gauges 26 may not be so evenly spaced apart from one another. It is anticipated that, depending upon the precise dimensions of the phased-array antenna, a greater plurality of strain gauges 26 may need to be concentrated at particular areas of the antenna, while a lesser plurality may be required near other areas, such as near the outermost edges of the antenna panel 24.

The output of each one of the strain gauges 26 is input to a fiber-optic strain demodulator 28 which provides electronic signals to a data acquisition system 30. The transformation algorithm is produced from a modal displacement transformation and a modal strain transformation, both of which are determined through steps 12–16 in FIG. 1. The data acquisition system 30 incorporates the strain-to-displacement algorithm needed to predict displacements of the antenna panel 24 over the entire area of the antenna panel. The transformation algorithm is represented by the following formula:

$$\{d\}=[\phi_d][[\phi_s]^T[\phi_s]^{-1}][\phi_s]^T\{\epsilon\}$$

where $\phi_d$=displacement mode shapes of the structural system (i.e., the phased-array antenna 24)

Figure 4:
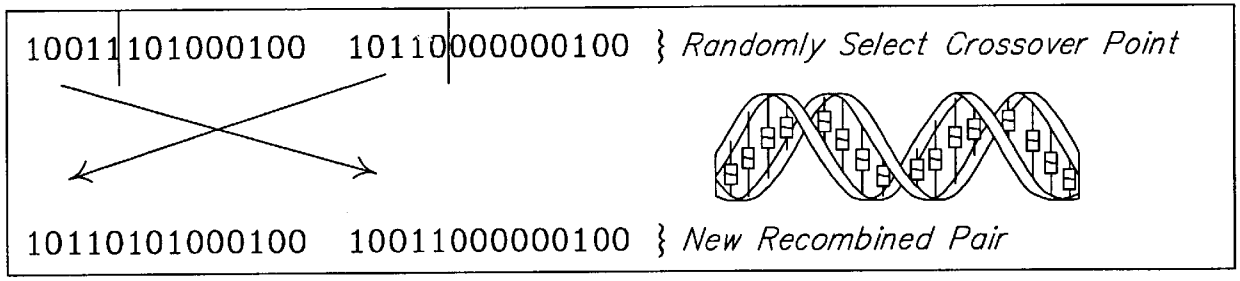
FIG. 4 is an illustration of a binary string, representing a solution variable, and a crossover print for determining the optimal placement of the strain gauges to represent specific deformed shapes.
Figure 5:
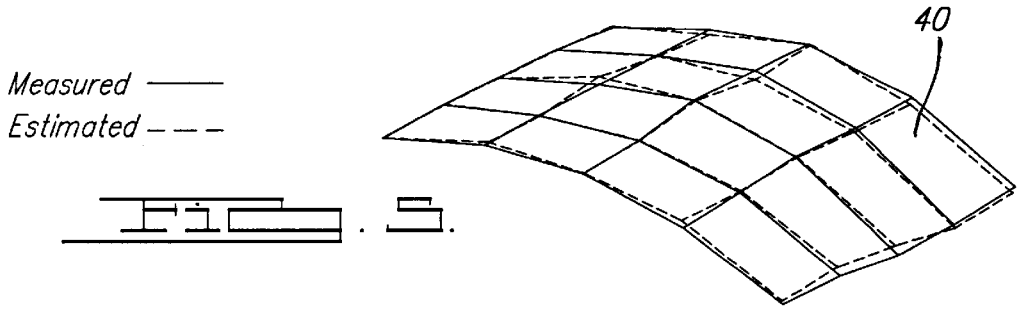
FIG. 5 is a simplified perspective view of a panel, representing a phased-array antenna, illustrating a measured surface deformation, represented by solid lines, together with the predicted deformation, indicated by dashed lines, as predicted by the deformation sensing devices of the present invention.
Figure 6:
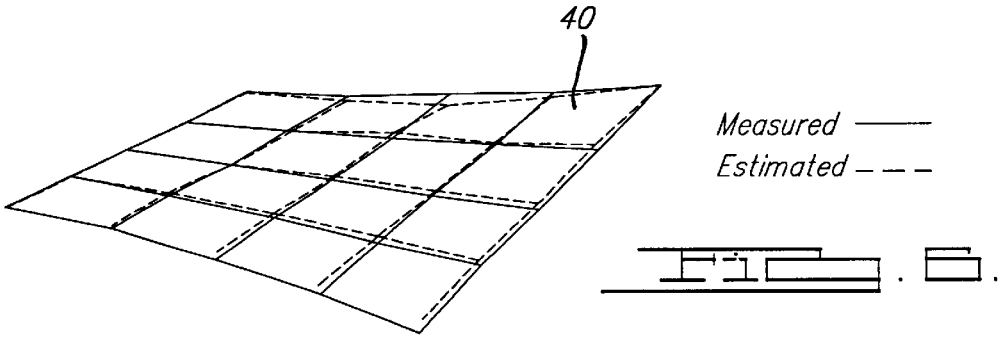
FIG. 6 is a view of the measured shape of a panel, representing an antenna, as indicated by solid lines, together with the predicted shape of the panel, indicated by dashed lines.
Figure 7:
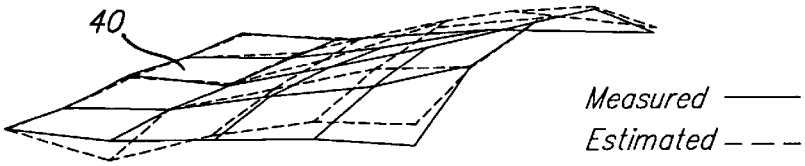
FIG. 7 is a view of a panel, representing an antenna, illustrating the measured shape thereof in solid lines, together with the predicted shape of the panel indicated by dashed lines.
Figure 8:
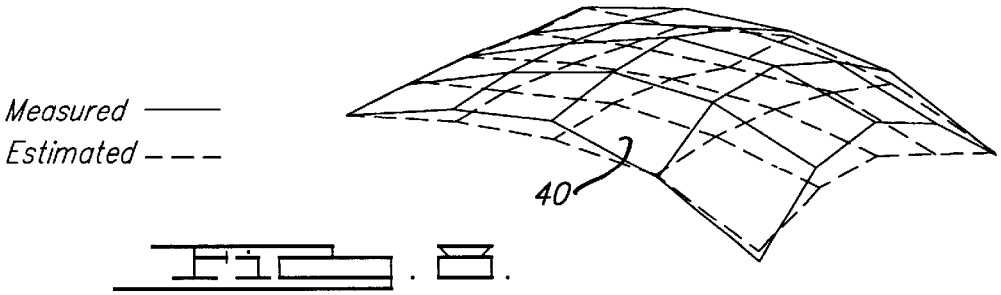
FIG. 8 is a view of a panel, representing an antenna, with the actual measured shape thereof indicated by solid lines, together with the predicted shape of the panel indicated by dashed lines.

$\phi_s$=the strain mode matrix of the structural system; and $\{\epsilon\}$=the actual strain measurements from the strain gauges With reference to FIG. 4, a genetic algorithm is used to determine optimum sensor placement along with the optimum number of sensors for a phased-array antenna of given dimensions. Genetic algorithms are well suited to the sensor placement problem since they, in general, involve manipulation of binary strings. The optimal placement of sensors is a chosen subset of a larger set of potential locations so as to minimize an objective or cost function. The solution defines whether a sensor is placed at a potential location or not (i.e., "1" or "0"). The solution can therefore be viewed as a binary string. An initial set of candidate optimal solutions are generated randomly as binary strings. They are then evaluated via a cost function. A subset of high performance candidates are chosen and randomly recombined in pairs. The new candidates are evaluated and the process repeats itself until some user defined conditions are reached. A random subset of candidate solutions are changed randomly so as to introduce a "mutation". This helps to avoid falling into a local optimization.

The cost function for the sensor placement problem can be generated a number of different ways. One way involves calculating the square root of the sum of differences between a set of representative (measured or calculated) displacements and strain mode transformation predicted displacements. This is then weighted by the number of strain gauges 26 raised to a power. The greater the power used, the fewer strain gauges 26 needed to minimize the cost function. However, the approximation to known displacements will be less accurate. The number of desired sensors can be fixed and the function will optimize their placement. The cost function can be represented by the following formula:

$$\left(\sqrt{\sum_{i=1}^{N_d}(x_p-x_k)^2}\right)(N_s)^P$$

where $N_d$=number of displacement locations;

$N_s$=number of active strain gauges 26;

$x_p$=transformation estimated deformation;

$x_k$=expected deformation; and

P=Arbitrary power

With continued reference to FIG. 2, the output from the data acquisition system 30 represents the predicted displacements of the antenna panel 24 (in the Z direction) over the entire area of the antenna panel. These outputs are input to a beam steering controller 32, which also receives inputs from a beam pointing command generator 34. If the antenna panel 24 is a space-based antenna, then the beam steering controller 32 also receives attitude information from a satellite/array attitude data generator 36. It will be appreciated that the beam steering controller 32 is well known in the art and therefore no further description will be provided for this component.

The beam steering controller 32 operates to generate a plurality of phase shift or time delay commands for electronically "steering" each of the independent antenna elements 24*a* which form the phased-array antenna 24. These commands electronically compensate for the predicted surface deformation. occurring over the entire area of the antenna 24. If the compensation commands are time delay commands, then true-time-delay (TTD) elements 38 can be used in connection with each antenna element 24*a* of the antenna panel 24. Importantly, the compensation commands, whether phase or time based, are applied to the antenna elements 24*a* in real time. Thus, essentially instantaneous corrections can be applied by the system 22 to compensate for the changing overall shape of the antenna panel 24. Since the surface deformation of the antenna panel 24 is compensated for electronically, the system 22 also forms a non-intrusive means which does not require significant additional structure to be used with the antenna panel 24. The system 22 therefore does not add significantly to the size, weight or overall complexity of the antenna panel 24.

Referring now to FIGS. 5–8, the results of tests conducted on a 36"×36" (0.914 m by 0.914 m) planar panel 40 are shown. In this test, strain readings from a plurality of the strain gauges 26 were collected while the panel 40 was subjected to external forces causing mechanical deflection of the panel 40. Direct measurements of the deformed panel 40 were taken using linear displacement measurement devices in contact with the panel 40 surface. The solid lines represent the measured surface of the panel 40 while the dashed lines represent the "estimated" or "predicted" curvature of the panel 40 surface compiled from information collected from the strain gauges 26. The very close overall similarity of the measured shape of the panel 40 and the estimated shape of the panel by using the strain gauges 26 and the data acquisition system 30 can be readily seen.

Figure 9:
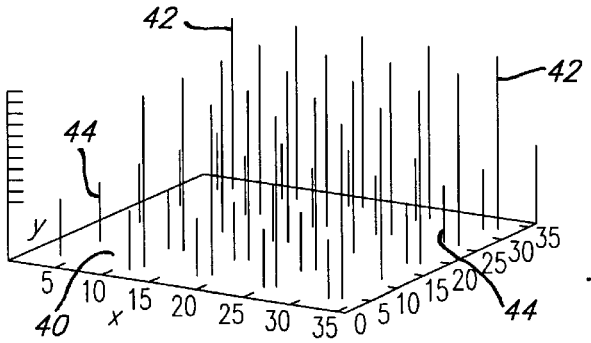
FIG. 9 is a perspective view of a panel illustrating the preferred locations of various pairs of deformation sensing devices thereon, where the short vertical lines represent locations for deformation sensing devices placed along an X axis, and the long vertical lines represent locations where a deformation sensing device is placed along a Y axis.
Figure 10:
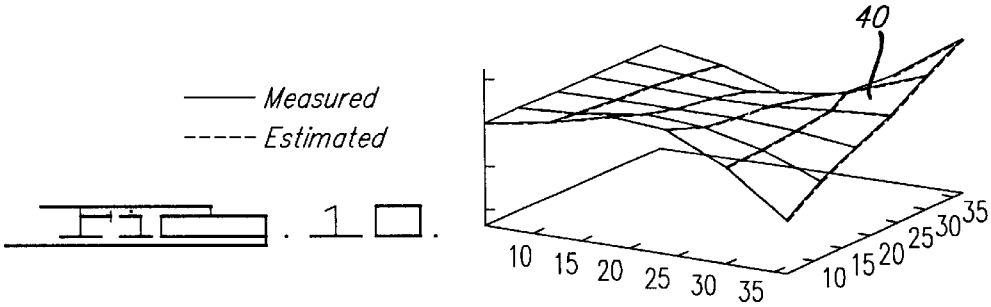
FIGS. 10–12 illustrate the high degree of correspondence between the measured surface of a panel, indicated by solid lines, and the predicted surface shape indicated by dashed lines, when the relatively large plurality of pairs of strain gauges indicated in FIG. 9 are employed.
Figure 11:
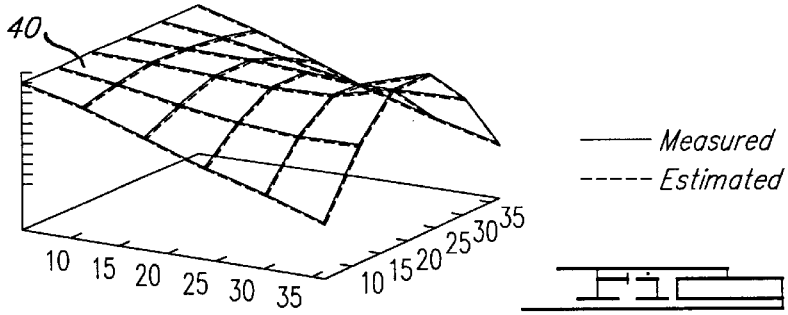
Figure 12:
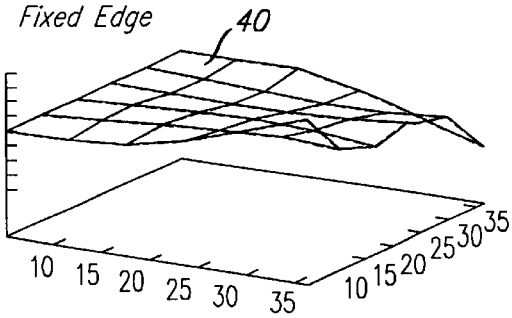

Referring to FIG. 9, the genetic algorithm described previously herein has been used to optimize the number and position of the strain gauges 26 for maximum implementation economy and effectiveness. The long vertical lines 42 in FIG. 9 represent those approximate locations on the 36"×36" panel 40 where strain gauges 26 should be disposed parallel to the Y axis. The short vertical lines 44 represent those approximate locations where a strain gauge 26 should be located parallel to the X axis. It will be noted that two strain gauges 26 are provided relatively closely adjacent to one another such that a plurality of pairs of strain gauges 26 are arranged at critical locations around the panel 40 where significant strains are expected to occur. FIGS. 10–12 illustrate the high correspondence of the predicted shape of the panel 40 relative to the measured shape when the panel 40 is deformed by external forces, with the strain gauges 26 placed as indicated in FIG. 9.

Figure 13:
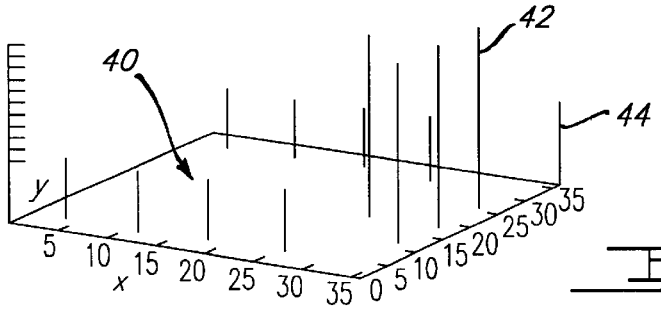
FIG. 13 illustrates the placement of fewer strain gauges on the panel.
Figure 14:
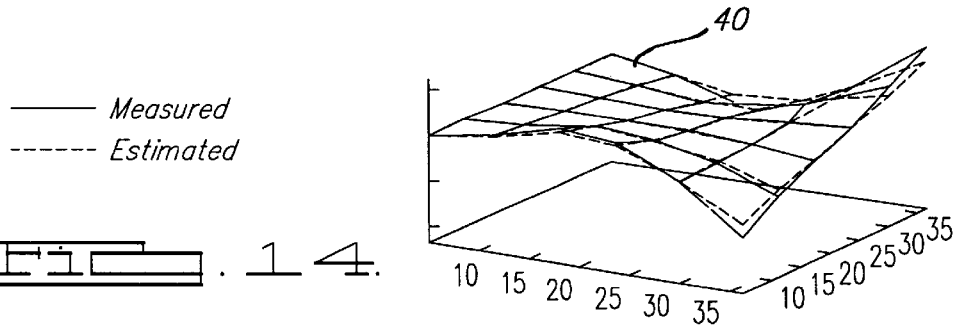
FIGS. 14–16 indicate the increased variation between the measured shape of the panel and the predicted shape as a result of the fewer number of strain gauges being employed, as shown in FIG. 13.
Figure 15:
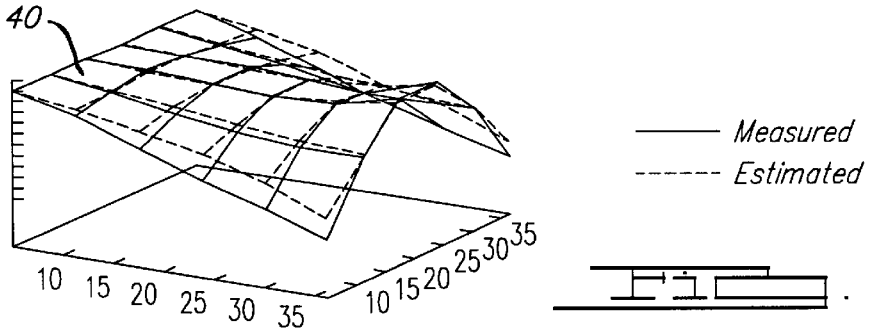
Figure 16:
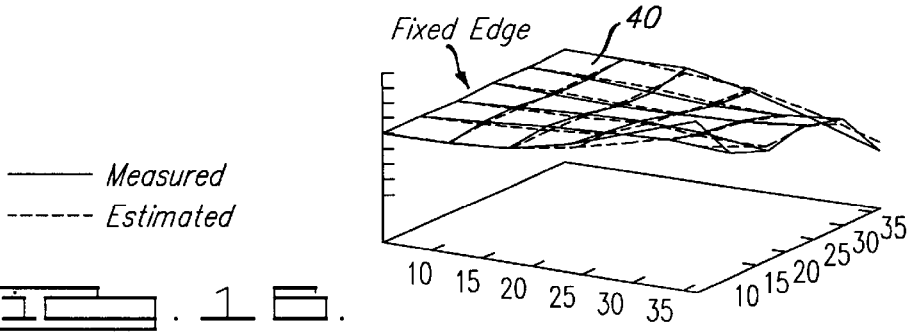

It will be appreciated, however, that the overall shape of the phased-array antenna will have a strong influence on the precise number and locations of the strain gauges 26 that will be required for use therewith. If the accuracy requirements are relaxed, then a lesser plurality of pairs of strain gauges 26 will likely be needed for any given size and shape of antenna 24. FIG. 13 illustrates the use of fewer strain gauges 26 on the planar panel 40, while FIGS. 14–16 illustrate the slightly increased difference between the measured shape of the panel (in solid lines) and the predicted shape (in dashed lines) resulting from the use of fewer strain gauges 26.

Figure 17:
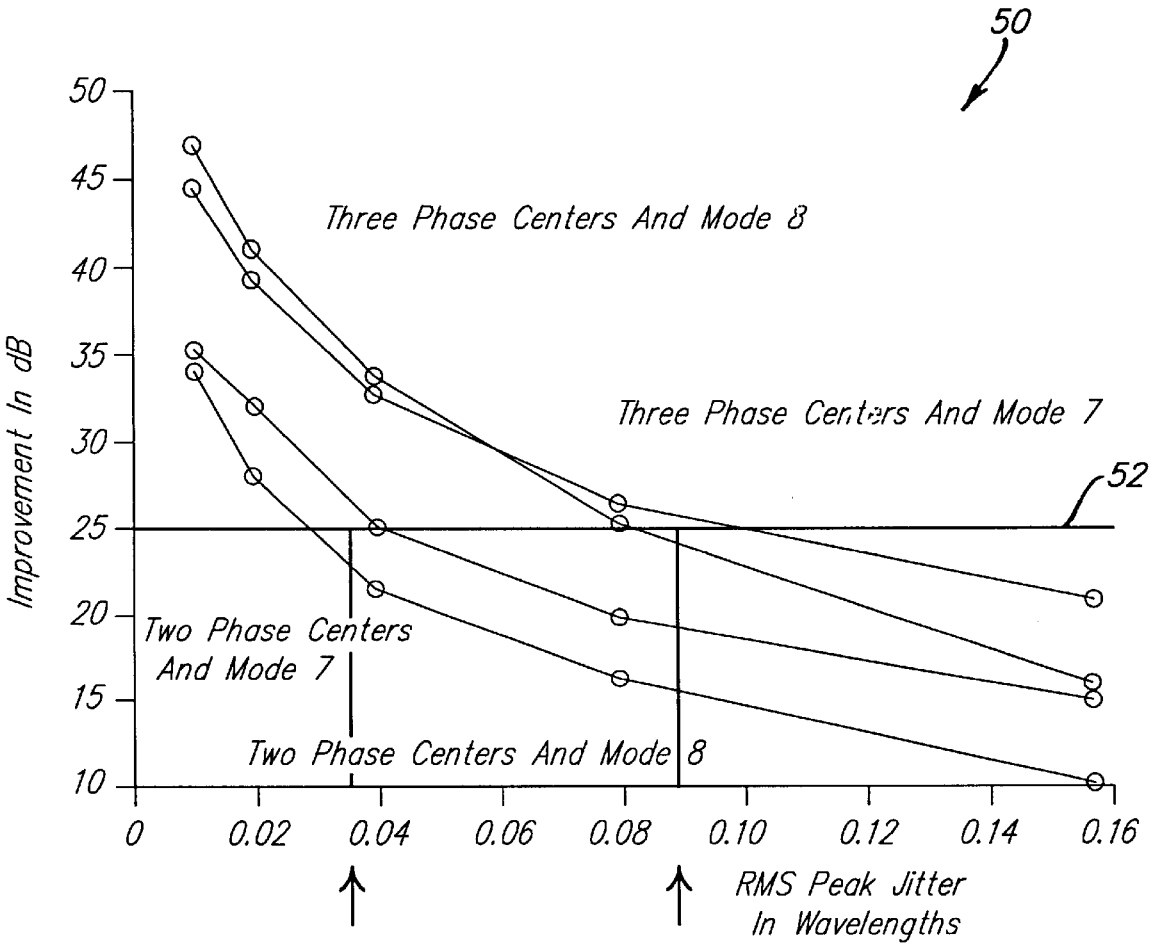
FIG. 17 is a graph the results of an antenna deflection simulation test illustrating the relationship between RMS surface distortion and clutter cancellation improvement ratio for a space-based radar application.

Referring now to FIG. 17, a graph 50 is shown which illustrates the results of an antenna deflection simulation of two vibration modes (i.e., labeled modes "7" and "8") to determine the relationship between root means square (RMS) surface distortion and the clutter cancellation improvement ratio for a large, phased-array antenna used in a space-based application. The clutter improvement ratio ("CIR") is summarized in the graph 50. The graph 50 plots 10 times the log to the base of 10 CIR, expressed in decibels, versus the RMS value of the maximum deflection. Results are shown for two and three phase centers. In the two phase center cases, the phased-array antenna 24 is divided into two sections with the payload body of a spacecraft associated with the antenna panel 24 in the middle of the antenna panel. A 25 dB CIR, denoted by line 52, is considered to be a threshold value for minimum allowable cancellation. This is about 10 dB above the minimum threshold for receiver noise effects. For three phase centers, the threshold is passed when the RMS peak deflection is between eight to ten percent of the radar signal wavelength. The two phase center results are a much more stringent three to four percent. Space borne antennas will use radio frequencies in the 10 Hz range, so that the signal wavelength is about 30 mm. The peak allowable deflection is thus about 2.5 mm (about 0.1 inches). Since the phased-array antenna panel 24 dimensions are assumed to be about five meters by eight meters, the maximum deflection of 2.5 mm is at a distance of four meters from the payload body center line.

The deformation detection and compensation system 22 is particularly well adapted for use with satellite systems that employ large, phased-array antennas mounted on light-weight support structures, and more specifically for space-based surveillance, optics and ground target tracking applications. However, the system 22 is just as readily useable with applications involving ground-based large, phased-array antennas or even aircraft-borne phased-array antennas.

A principal advantage of the present invention is the ability to reduce the mass and volume of the overall antenna system due to the lesser stability requirements for the structure supporting the antenna. This allows even larger phased-array antennas to be packaged with existing launch vehicles when the antenna system is to be used in a space-based application, thus enabling new missions previously considered impossible or economically unlivable. The elimination of the need for ultra-stable, high tolerance support structures for supporting large, phased-array antennas also permits a significant reduction in the mass of a phased-array antenna by a factor of up to about 40%, or possibly even greater. Presently, large phased-array antenna systems using the conventional structural approach have a mass density on the order of about 12 kg/m$^2$. It is anticipated that a large, phased-array antenna can be constructed having a mass density of about 7 kg/m$^2$. Presently, the largest phased-array antenna launchable using conventional approaches is approximately 130 m$^2$. However, a phased-array antenna system incorporating the deformation compensation system described herein permits structural mass and volume minimization to a degree which allows up to, or possibly greater than, 450 m$^2$ deployable, phased-array antennas to be launched into space. It is also anticipated that the implementation of the deformation detection and compensation system 22 of the present invention will result in significant reductions (up to or greater than about 50%) in antenna calibration costs during the integration and test processes associated with phased-array antenna systems.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A system for detecting surface deformation in a planar, phased-array antenna, said system comprising:

a plurality of pairs of deformation sensing devices disposed on said phased-array antenna at a plurality of predetermined locations for sensing X and Y components of strain occurring at a plurality of designated locations as a result of deformation of said antenna and generating a plurality of output signals in accordance with said sensed strain; and a deformation detecting system responsive to said output signals for determining displacements, in X and Y directions, occurring at said designated locations of said antenna as a result of said surface deformation of said antenna.

2. The system of claim 1, wherein said deformation detecting system further comprises means for generating surface deformation compensation signals to compensate for a phase shift in a signal transmitted or received by said phased-array antenna as a result of said surface deformation.

3. The system of claim 1, wherein said deformation detecting system includes a delay element for modifying the phase of a signal received or transmitted by said antenna in a manner to correct for said surface deformation of said phased-array antenna at said area.

4. The system of claim 1, wherein said deformation detecting system includes:

a beam steering controller; and at least one true-time-delay (TTD) element responsive to said beam steering controller for electronically modifying a signal received or transmitted by said phased-array antenna to compensate for said surface deformation thereof.

5. The system of claim 1, wherein said deformation sensing device comprises a strain gauge.

6. The system of claim 1, wherein said deformation sensing device comprises a fiber-optic strain gauge.

7. A system for compensating for surface deformation in a planar, phased-array antenna in real time, said system comprising:

a plurality of pairs of first and second strain gauges disposed on said phased-array antenna at a corresponding plurality of desired locations where significant strains are expected to occur as a result of forces experienced by said phased-array antenna;

each said first one of each of said pairs of strain gauges operating to sense an X-component of each of said strains occurring at its associated position on said antenna and generating a first output signal representing an X-axis component of its said sensed strain at its associated said desired location;

each said second one of each of said pairs of strain gauges operating to sense a Y-component of each of said strains occurring at its associated position on said antenna and generating a second output signal representing a Y-axis component of its said sensed strain at its associated said desired location;

a data acquisition system for receiving said first and second output signals and generating corresponding displacement signals representing the deformation of said antenna; and a beam steering controller for receiving said displacement signals and generating commands applied to said antenna and adapted to compensate for said displacements at said desired locations on said antenna.

8. The system of claim 7, further comprising at least one time delay element responsive to said commands from said beam steering controller for modifying signals received by said antenna to compensate for said surface deformation occurring at said desired locations.

9. The system of claim 7, wherein each of said strain gauges comprises a fiber-optic strain gauge.

10. The system of claim 7, wherein each of said strain gauges comprises a fiber-optic strain gauge; and further comprising a fiber-optic strain demodulator responsive to said first and second output signals from said fiber-optic strain gauges.

11. The system of claim 7, further comprising a system for supplying beam pointing commands to said beam steering controller.

12. The system of claim 7, further comprising a system for determining an attitude of said phased-array antenna and supplying signals indicative thereof to said beam steering controller.

13. A method for detecting out-of-plane surface deformation of a phased-array antenna, said method comprising the steps of:

using a strain sensing device disposed on said phased-array antenna to sense a strain at a predetermined location on said phased-array antenna and to generate a signal indicative of said sensed strain;

using a displacement predicting system to receive said signal from said strain sensing device and to estimate therefrom an approximate deformed shape of said antenna;

using a beam steering controller to modify signals transmitted from or received by said antenna to compensate for said deformed shape of said phased-array antenna; and using information concerning an attitude of said phased-array antenna to modify signals transmitted from or received by said phased-array antenna.

14. The method of claim 13, further comprising the step of:

using a plurality of pairs of strain sensing devices disposed at a plurality of selected locations on said phased-array antenna.

15. The method of claim 13, wherein the step of using said strain sensing device comprises the step of using a fiber-optic strain gauge.

16. The method of claim 15, further comprising the step of using a fiber-optic strain demodulator for receiving signals from said fiber-optic strain gauge and transmitting said signal to said displacement predicting system.

17. A system for detecting surface deformation in a planar, phased-array antenna, said system comprising:

at least one strain gauge for detecting strain occurring at a predetermined location on said antenna in one of an X direction or a Y direction;

a strain demodulator for receiving output signals from said strain gauges and generating electrical signals in accordance therewith;

a data acquisition system for receiving said electrical signals generated by said strain gauge and generating therefrom corresponding displacement signals representative of displacement of a predetermined portion of said antenna; and a beam steering controller for receiving said displacement signals and generating commands applied to said antenna to compensate for said displacement of said predetermined portion of said antenna.

* * * * *